US008328312B2

(12) United States Patent
Kwon et al.

(10) Patent No.: US 8,328,312 B2
(45) Date of Patent: Dec. 11, 2012

(54) METHOD FOR INKJET PRINTING

(75) Inventors: Seong-Gyu Kwon, Suwon-si (KR); Tae-Gee Min, Seoul (KR); Yi-Seop Shim, Suwon-si (KR); Jae-Hoon Kim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 544 days.

(21) Appl. No.: 12/619,434

(22) Filed: Nov. 16, 2009

(65) Prior Publication Data

US 2010/0309241 A1 Dec. 9, 2010

(30) Foreign Application Priority Data

Jun. 5, 2009 (KR) ..... 10-2009-0050069

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 7,514,187 | B2 * | 4/2009 | Kiguchi et al. | 430/7 |
| 7,820,735 | B2 * | 10/2010 | Kang et al. | 523/160 |
| 8,191,260 | B2 * | 6/2012 | Kato et al. | 29/890.1 |
| 2001/0028916 | A1 * | 10/2001 | Akahira | 427/8 |
| 2007/0070107 | A1 | 3/2007 | Shamoun et al. | |
| 2007/0070109 | A1 | 3/2007 | White et al. | |
| 2007/0263862 | A1 | 11/2007 | Tseng et al. | |

FOREIGN PATENT DOCUMENTS

| | | | |
|---|---|---|---|
| JP | 09033710 | A | 2/1997 |
| JP | 2005014465 | A | 1/2005 |
| JP | 2006003725 | A | 1/2006 |
| JP | 2008149292 | A | 7/2008 |
| KR | 1020050075980 | A | 7/2005 |
| KR | 1020060032857 | A | 4/2006 |
| KR | 1020070027074 | A | 3/2007 |
| KR | 1020080059706 | A | 7/2008 |
| KR | 1020080105670 | A | 12/2008 |
| KR | 1020090010120 | A | 1/2009 |

* cited by examiner

*Primary Examiner* — Charlie Peng
(74) *Attorney, Agent, or Firm* — Cantor Colburn LLP

(57) ABSTRACT

A method for inkjet printing includes providing a light blocking member pattern including a plurality of openings at positions corresponding to pixels, dripping a dummy ink drop on the light blocking member pattern by using an inkjet printer, providing a CCD (charge-coupled device) image for the dripped dummy ink drop, representing the CCD image on rectangular coordinates, calculating a central point under an x-axis and a y-axis of the CCD image, calculating an escape value as a deviation of the central point under the x-axis and the y-axis in the CCD image from a reference point established by the inkjet printer, calculating a time adjustment value of the ink drip based on the escape value, and controlling the time for the ink drip for each nozzle of the inkjet printer by the time adjustment value of the ink drip.

7 Claims, 8 Drawing Sheets

METHOD FOR INKJET PRINTING

This application claims priority to Korean Patent Application No. 10-2009-0050069 filed on Jun. 5, 2009, and all the benefits accruing therefrom under 35 U.S.C. §119, the entire contents of which are incorporated herein by reference.

BACKGROUND OF THE INVENTION (a) Field of the Invention

The present invention relates to a method for inkjet printing.

(b) Description of the Related Art

A liquid crystal display is provided with a pixel including a switching element, a display signal line including a gate line and a data line, and a color filter for realizing images of full color.

The color filter may be formed through photolithography or inkjet printing.

In inkjet printing, a light blocking member, such as a black matrix, is deposited on an insulation substrate, the deposited light blocking member is exposed and developed to form an opening corresponding to the pixel, and ink for the color filter is dripped in the opening formed in the light blocking member.

An inkjet head for dripping the ink for the color filter includes more than fifty nozzles, and the positions of ink droplets that are respectively dripped from the nozzles are different.

An engineer directly checks and controls the dripping position when dripping the color filter ink, so as to ensure the ink is dripped at correct positions in the openings of the light blocking member. However, when the dripped ink is not maintained with a symmetrical (e.g., circular) shape inside the opening formed in the light blocking member, or when the dripped ink is collected in one direction (e.g., asymmetrical), it is difficult to determine how the nozzles are moved numerically during the dripping process.

The dripped color filter ink is spread freely in the opening formed in the light blocking layer, such that it is difficult to determine a position of misalignment of the dripped ink only through the spread shape of the ink, after the ink has been disposed in the opening. Accordingly, the ink may be spread between neighboring color filters due to misalignment of the dripped ink, and as a result the display characteristics of the display device may be deteriorated.

BRIEF SUMMARY OF THE INVENTION

The invention drips ink at a correct position by compensating misalignment of the drip after checking the dripping position of the ink.

An exemplary embodiment of a method for inkjet printing according to the invention includes providing a light blocking member pattern including a plurality of openings at positions corresponding to pixels, dripping a dummy ink drop on the light blocking member pattern by using an inkjet printer, providing a CCD (charge-coupled device) image of the dripped dummy ink drop, representing the CCD image on rectangular coordinates, calculating a central point under an x-axis and a central point under a y-axis of the CCD image, calculating an escape value as a degree that the central point under the x-axis and the central point under the y-axis of the CCD image of the dripped dummy ink drop is deviated from a reference point according to establishment of the inkjet printer, calculating a time adjustment value of the ink drip on the basis of the escape value, and controlling the time for the ink drip for each nozzle of the inkjet printer by the time adjustment value of the ink drip.

The dripping of the dummy ink drop on the light blocking member pattern by using the inkjet printer may be executed while inkjet printing a color filter ink in openings to form a color filter of a display device.

The calculating of the time adjustment value of the ink drip on the basis of the escape value may include dividing the value of the y-axis direction by a moving speed of the nozzle of the inkjet printer when the proceeding (e.g., printing) direction of the inkjet printer is parallel to the y-axis direction.

The reference point according to the establishment of the inkjet printer may be determined with reference to the coordinate value of an edge or a center of an opening.

An exemplary embodiment of a method for inkjet printing according to the invention includes dripping a dummy ink drop by using an inkjet printer, determining a position of the dripped dummy ink drop, calculating an escape value as a degree that the position of the dripped dummy ink drop is deviated from a reference ink drip position according to the establishment of the inkjet printer, calculating a time adjustment value of the ink drip on the basis of the escape value, and controlling the time for the ink drip for each nozzle of the inkjet printer by the time adjustment value of the ink drip.

The calculating of the time adjustment value of the ink drip on the basis of the escape value may include dividing the value of the y-axis direction by a moving speed of the nozzle of the inkjet printer when the proceeding (e.g., printing) direction of the inkjet printer is parallel to the y-axis direction.

The reference position according to the establishment of the inkjet printer may be determined with reference to the coordinate value of an edge or a center of an opening at the positions corresponding to the pixels.

According to exemplary embodiments of the invention, misalignment of the ink drip is compensated, thereby dripping the ink on the correct position.

DETAILED DESCRIPTION OF THE INVENTION

Figure 1:
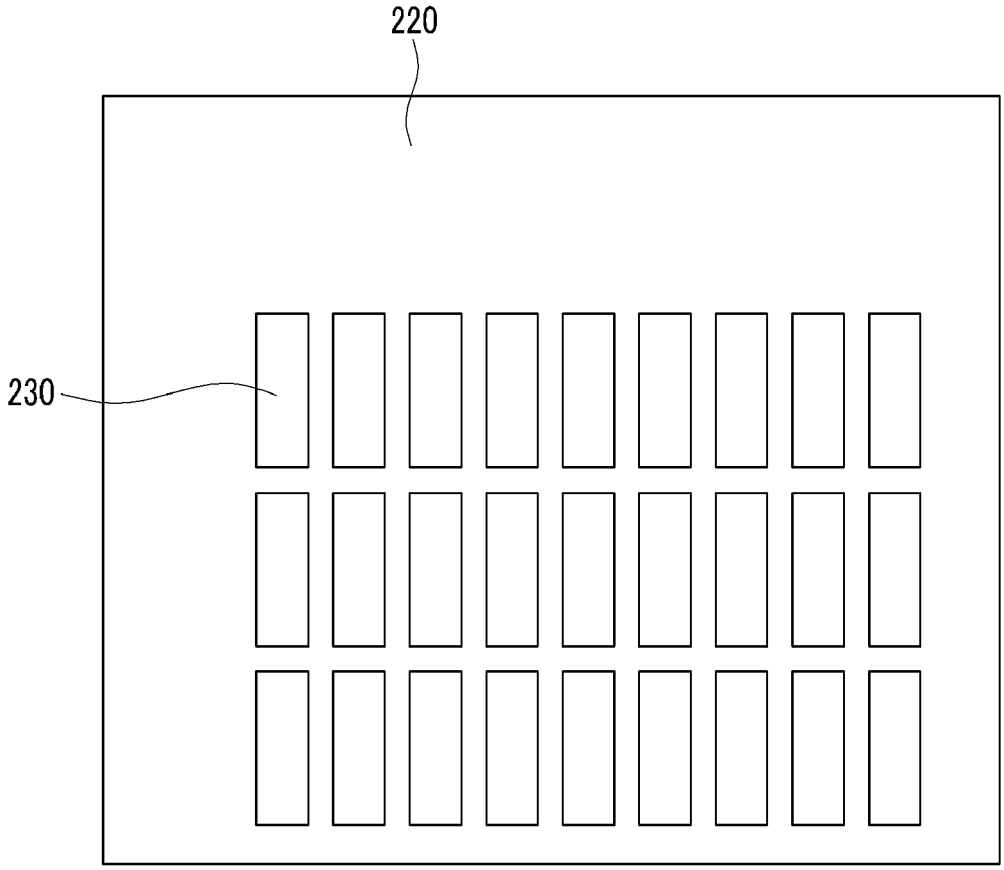
FIG. 1 to FIG. 8 are views sequentially showing an exemplary embodiment of a method for compensating an ink dripping position, in a method for inkjet printing according to the invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "upper" and the like, may be used herein for ease of description to describe the relationship of one element or feature to another element(s) or feature (s) as illustrated in the figures. It will be understood that the spatially relative terms are intended to encompass different orientations of the device in use or operation, in addition to the orientation depicted in the figures. For example, if the device in the figures is turned over, elements described as "upper" relative to other elements or features would then be oriented "lower" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be described in detail with reference to the accompanying drawings.

FIG. 1 to FIG. 8 are views sequentially showing an exemplary embodiment of a method for compensating an ink dripping position, in a method for inkjet printing according to the invention.

As shown in FIG. 1, a light blocking member pattern 220 for a test is provided. The test light blocking member pattern 220 has a plurality of an opening 230 at positions corresponding to pixel areas of a display device, that is, regions where a color filter ink will be dripped thereonto in a non-test light blocking member, such as to form the color filter of the display device.

The openings 230 are areas where material of the test light blocking member pattern 220 is absent. The openings 230 are considered enclosed openings penetrating the test light blocking member pattern 220, where the light blocking member pattern 220 solely defines the enclosed openings 230. Also, the test light blocking member pattern 220 includes a dummy region where a plurality of a dummy ink drop 231 (FIG. 4) will be dripped, and the dummy region does not include the openings 230.

After the test light blocking member pattern 220 including the plurality of the opening 230 is formed, a reference point to drip a dummy ink drop 231 is determined. The reference point, such as in the dummy region, to drip the dummy ink drop 231 may be determined with reference to a center of an opening 230 or to an edge of the opening 230, in a plan view of the test light blocking member pattern 220 including the openings 230.

Figure 2:
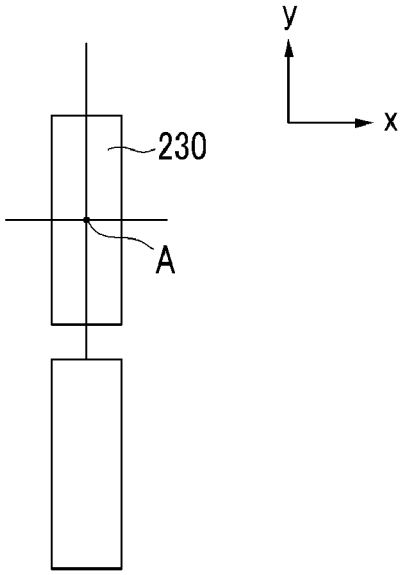
Figure 3:
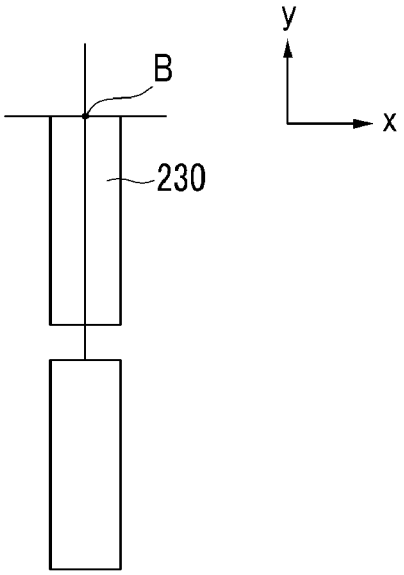

A position "A" as shown in FIG. 2, illustrates determining the reference point with respect to the center of the opening 230, where a position "B" as shown in FIG. 3 illustrates determining the reference point with respect to the edge of the opening 230. For orientation purposes, a coordinate system may be used where a first direction extends along a y-axis direction, and a second direction extends along an x-axis direction, where the y-axis is substantially perpendicular to the x-axis, and a third direction along a z-axis (not shown) is substantially perpendicular to both the x- and y-axes.

In an exemplary embodiment of determining the reference point to drip the dummy ink drop 231, the test light blocking member pattern 220 including the openings 230 is analyzed through a charge-coupled device ("CCD") image to calculate the coordinates of the positions "A" or "B." The CCD may also be employed to determine a position that is spaced apart from or deviated by a determined distance from the position A or B, as the reference point of the drip of the dummy ink drop 231.

Figure 4:
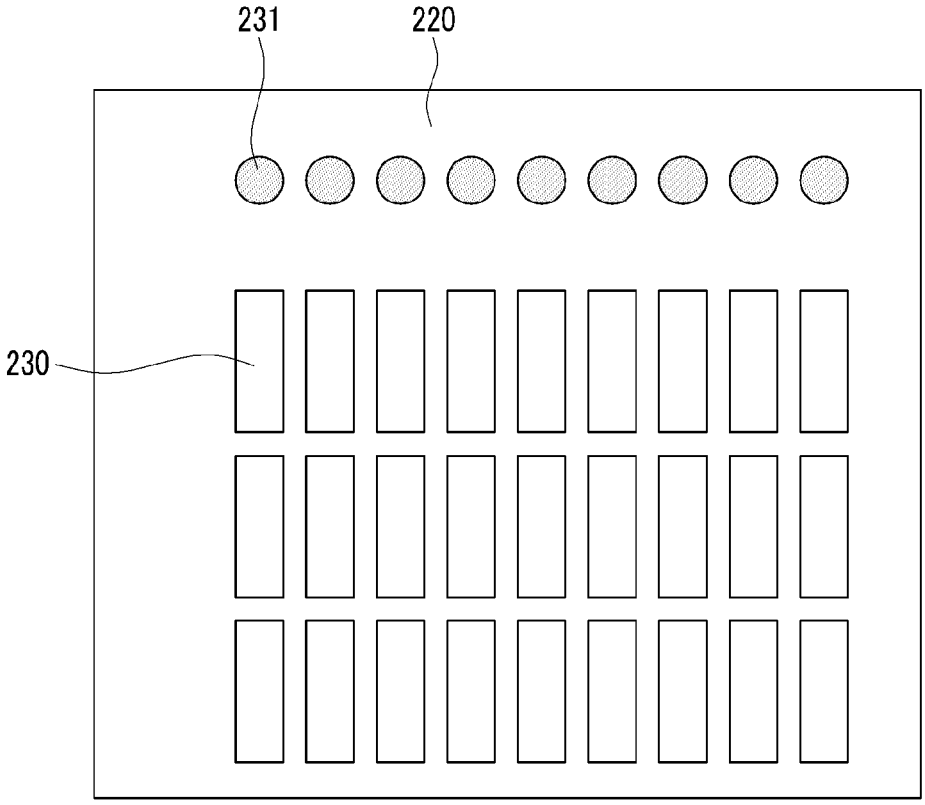

After the reference point to drip the dummy ink drop 231 is established based on the openings 230, as shown in FIG. 4, the dummy ink drop 231 is disposed or deposited (e.g., dripped by the inkjet printer) onto a remaining portion of the test light blocking member pattern 220 which does not include any opening 230. The location of the disposed dummy ink drops 231 in the dummy region may be aligned with a column of the openings 230 of the test light blocking member pattern 220, since the reference point to drip the dummy ink drop 231 is determined with reference to the dimensions and/or arrangement of the openings 230 as corresponding the color filter of the display device.

While the plurality of the dummy ink drops 231 is illustrated as disposed along only one first (upper horizontal) edge of the test light blocking member pattern 220 and arranged extended only in the first edge direction, the plurality of the dummy ink drops 231 may be disposed along a second (vertical) edge of the test light blocking member pattern 220 which is perpendicular to the first (horizontal) edge. The plurality of dummy ink drops 231 may also be arranged along only the second edge direction, or along both the first and second edge directions.

In an exemplary embodiment, the drip of the dummy ink drop 231 in the dummy region of the test light blocking member pattern 220 may be executed at substantially a same time or in a same process with the disposing of a color filter ink for a non-test color filter, such as during an inkjet printing, at the opening 230 of the test light blocking member pattern 220 or a non-test light blocking member pattern (not shown). When the dummy ink drop 231 is deposited on the test light blocking member pattern 220, the dummy ink drop 231 is formed under substantially the same conditions as the process for actually forming the color filter of a display device through the inkjet printing process.

Figure 5:
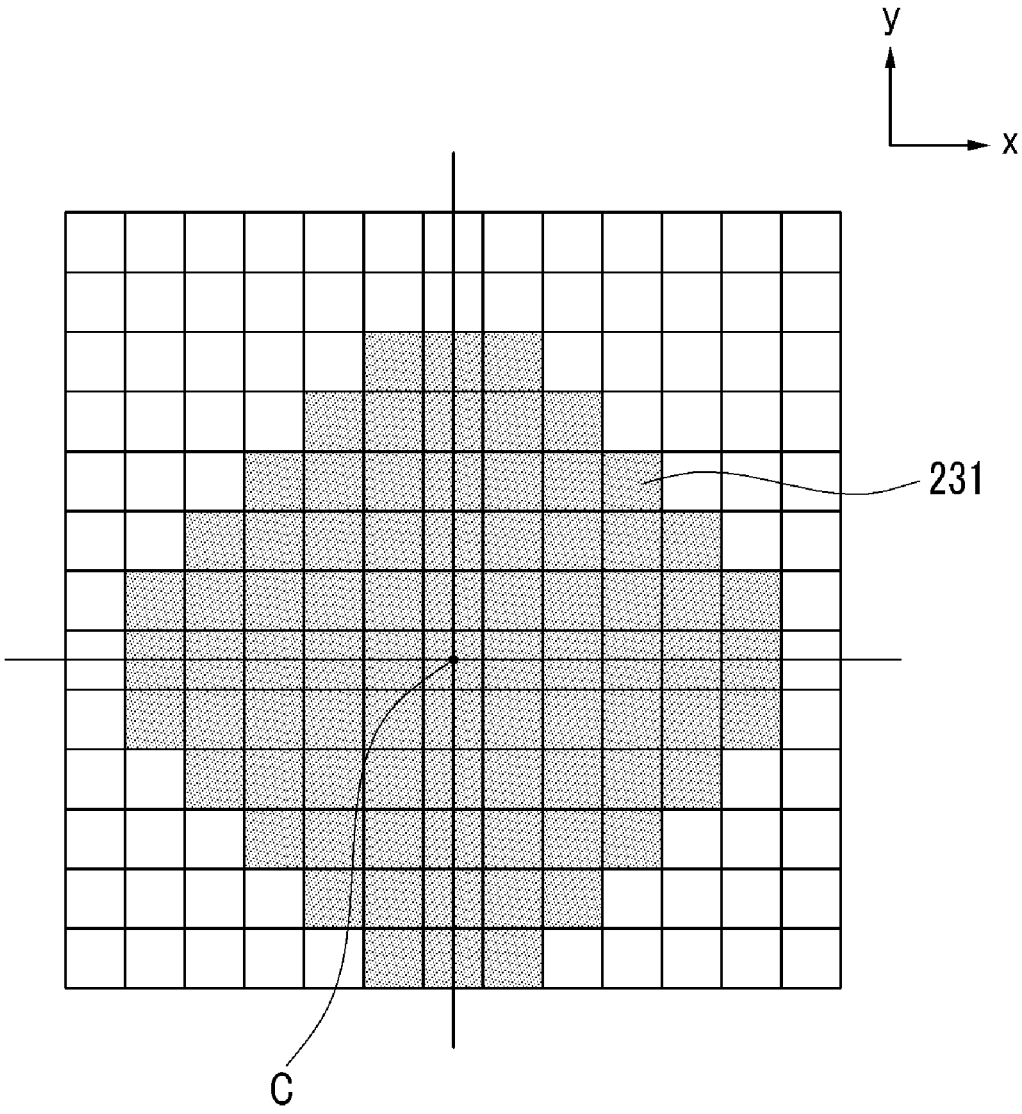

As shown in FIG. 5, the dripped dummy ink drop 231 disposed on the test light blocking member pattern 220 is photographed to provide the CCD image, and the image for the dripped dummy ink drop 231 is represented on a rectangular coordinate system. The dummy ink drop 231 is shown shaded within the rectangular coordinate system, and is illustrated as a substantially symmetrical feature. Here, the scale of the coordinate axis system may be determined as a unit of an actual pixel size in the display device, of the CCD image in the rectangular coordinate system. A central point along the x-axis and a central point along the y-axis of the CCD image for the dummy ink drop 231 (e.g., the shaded area in FIG. 5), which are obtained as described above, are determined and used to calculate the coordinate value of the central position C of the ink drop 231. As shown in FIG. 5, the central points of the actual dripped dummy ink drop 231 coincides with the reference point for the drip of the dummy ink drop established by the inkjet printer reference to dimensions and/or arrangement of the openings 230.

Figure 6:
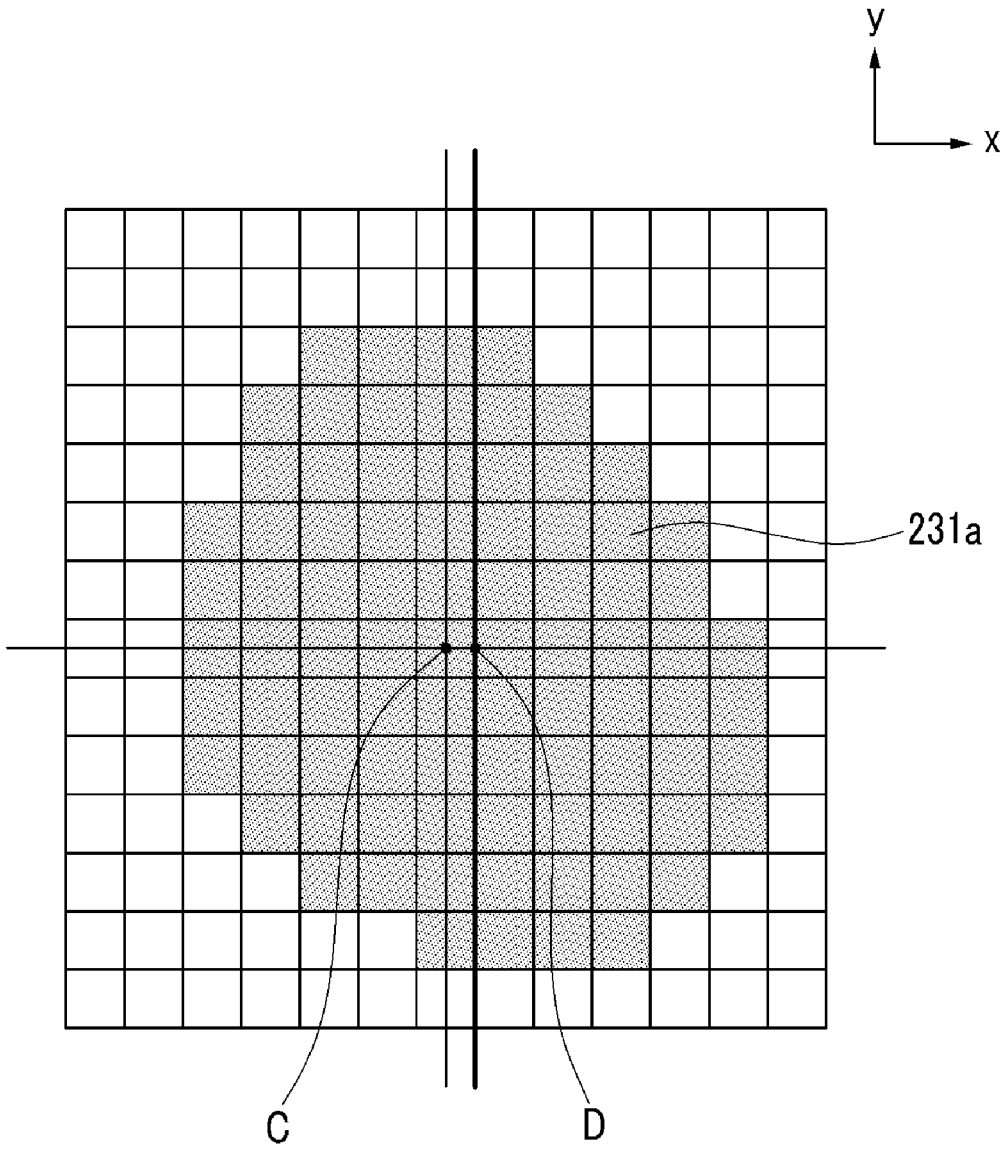
Figure 7:
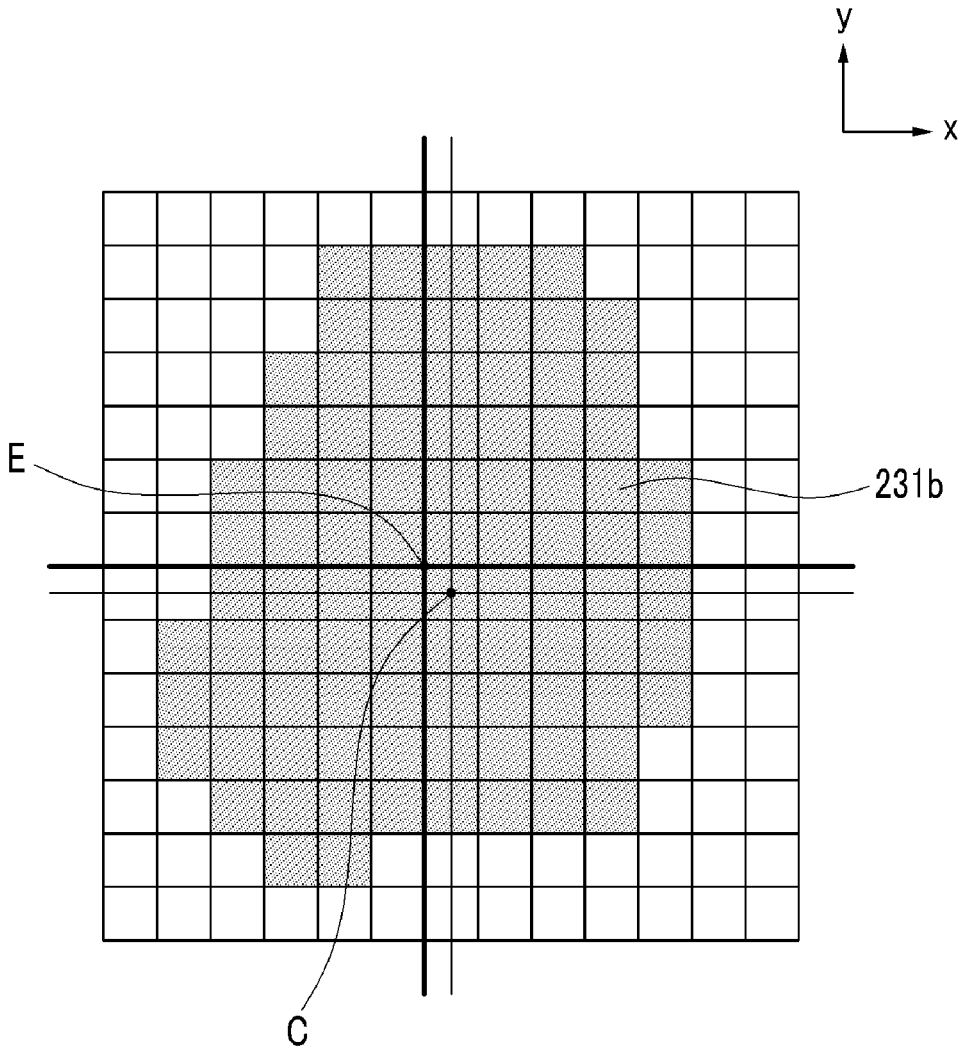

When the shape of the dripped dummy ink drop 231 is not symmetrical, as shown in FIG. 6 or FIG. 7, the central points of the actual dripped dummy ink drops 231*a* and 231*b*, do not coincide with the reference point for the drip of the dummy ink drop according to the determination of the inkjet printer. When the reference point for the drip of the dummy ink drop according to the establishment of the inkjet printer is referred to as x0 and y0, and the central point of the actual dripped dummy ink drop is referred to as x1 and y1, an escape value as the degree (or coordinate distance) that the central point of the actual dripped dummy ink drops 231*a* and 231*b* is deviated from the reference point for the drip of the dummy ink drop according to the establishment of the inkjet printer, may be calculated as x1−x0 and y1−y0.

FIG. 6 illustrates the central point of the actual dripped dummy ink drop 231*a* is deviated from the reference point for the drip of the dummy ink drop according to the establishment of the inkjet printer in the x-direction, and FIG. 7 illustrates the central point of the actual dripped dummy ink drop 231*b* is deviated from the reference point for the drip of the dummy ink drop according to the establishment of the inkjet printer in both the x- and y-directions. As described above, reasons that the central point of the actual dripped dummy ink drops 231*a* and 231*b* is deviated from the reference point for the drip of the dummy ink drop according to the establishment of the inkjet printer, are due to various factors such as non-uniformity of the nozzles of the inkjet printer and/or contamination of the surroundings of the ink or the nozzle of the inkjet printer.

After calculation of the escape value, the reference point for the drip of the dummy ink drop according to the establishment of the printer is compensated and adjusted on the basis of the above-obtained escape value. The adjustment of the reference point for the drip of the dummy ink drop allows the actual dripped ink drop and the reference point for the drip of the dummy ink drop 231 to coincide and align with each other.

In an exemplary embodiment of a method for compensating the establishment of the reference point for the drip of the dummy ink drop by the inkjet printer, an inkjet printing process parameter, such as an ink drip time of each nozzle of the inkjet printer, may be controlled. To control the ink drip time of each nozzle of the inkjet printer, the component (y1−y0) of a printing proceeding direction (e.g., the y-axis direction) of the inkjet printer among the escape value x1−x0 and y1−y0, is divided by the moving speed V of the nozzle of the inkjet printer, thereby calculating a time adjustment value (y1−y0)/V of the ink drip. That is, the deviation of the dripped dummy ink drop 231 in the dummy region of the test light blocking pattern 220 is used to adjust the a drip time of each nozzle in the inkjet printing process before the forming of the actual color filter of the display device by the inkjet printing process.

Figure 8:
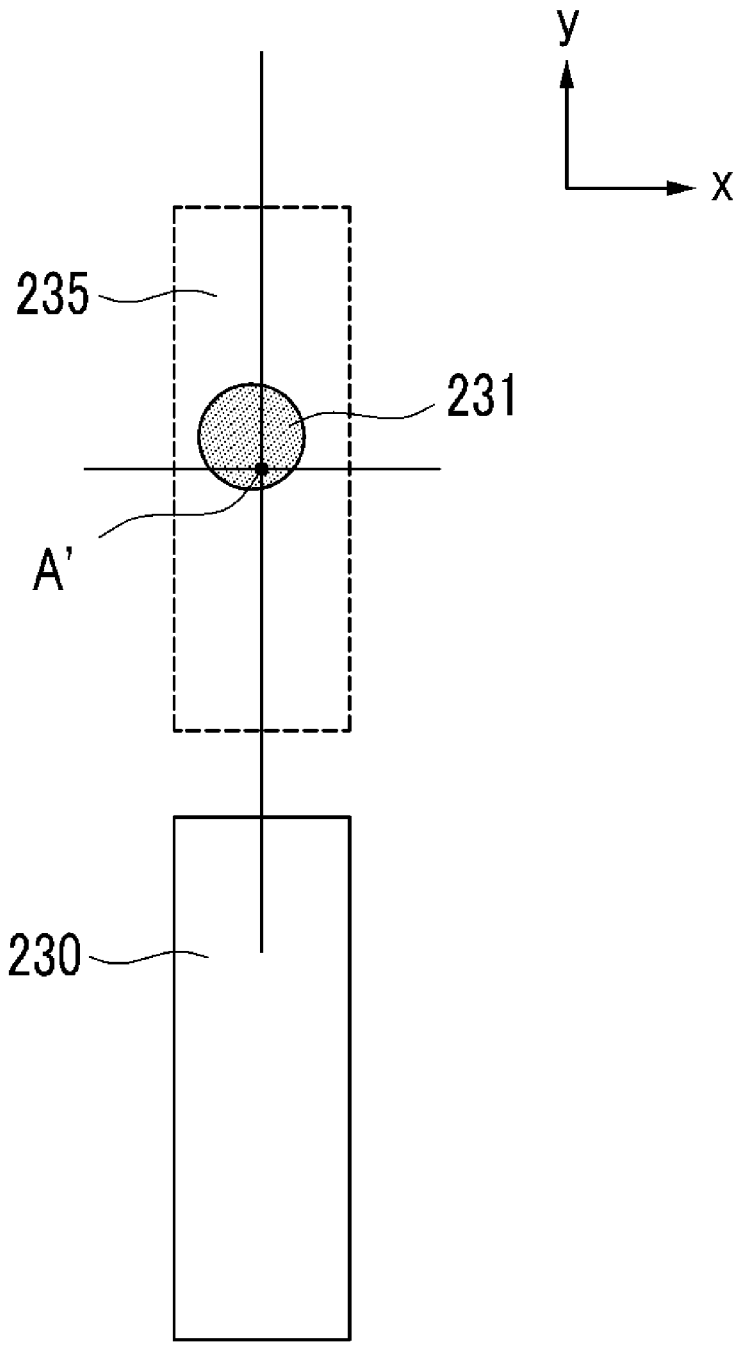

In one exemplary embodiment, as shown in FIG. 8, if the dummy ink drop 231 is positioned above a center of an imaginary pixel area 235, such as in the dummy region, which mirrors a shape and/or dimensions of the opening 230 in the test light blocking member pattern 220, the time of the ink drip is delayed to drip the ink drop at the center of the opening 230. As discussed above, each of the openings 230 correspond to a location of a pixel area of a display device, where a color filter will be formed.

As described above in the exemplary embodiment of the method of compensating an ink dripping position, in a method for inkjet printing according to the invention, the dummy ink drop 231 is dripped relative to a dummy pixel area on the test light blocking member pattern 220 having the opening 230 and is changed into the CCD image to calculate the escape value, and the reference point for the drip of the dummy ink drop established by the inkjet printer is compensated using the escape value before proceeding with the process for forming the actual color filter of the display device, such that a uniform color filter may be formed.

Where a dripped dummy ink is deposited on a test pattern which includes test openings corresponding to dimensions of an actual color filter of a display device, and a deviation in a plan view of the deposited dummy ink from the dimensions of the actual color filter is used to set inkjet printing parameters, such as a time of an ink drip for the forming of the actual color filter, a position of the color filter ink for forming the actual color filter can be determined before the color filter ink has been disposed in openings for the actual color filter. Accordingly, spread of ink between neighboring color filters due to misalignment of the dripped color filter ink may be reduced or effectively prevented, manufacturing costs and time may be reduced, and display characteristics of the display device may be improved.

Figure 9:
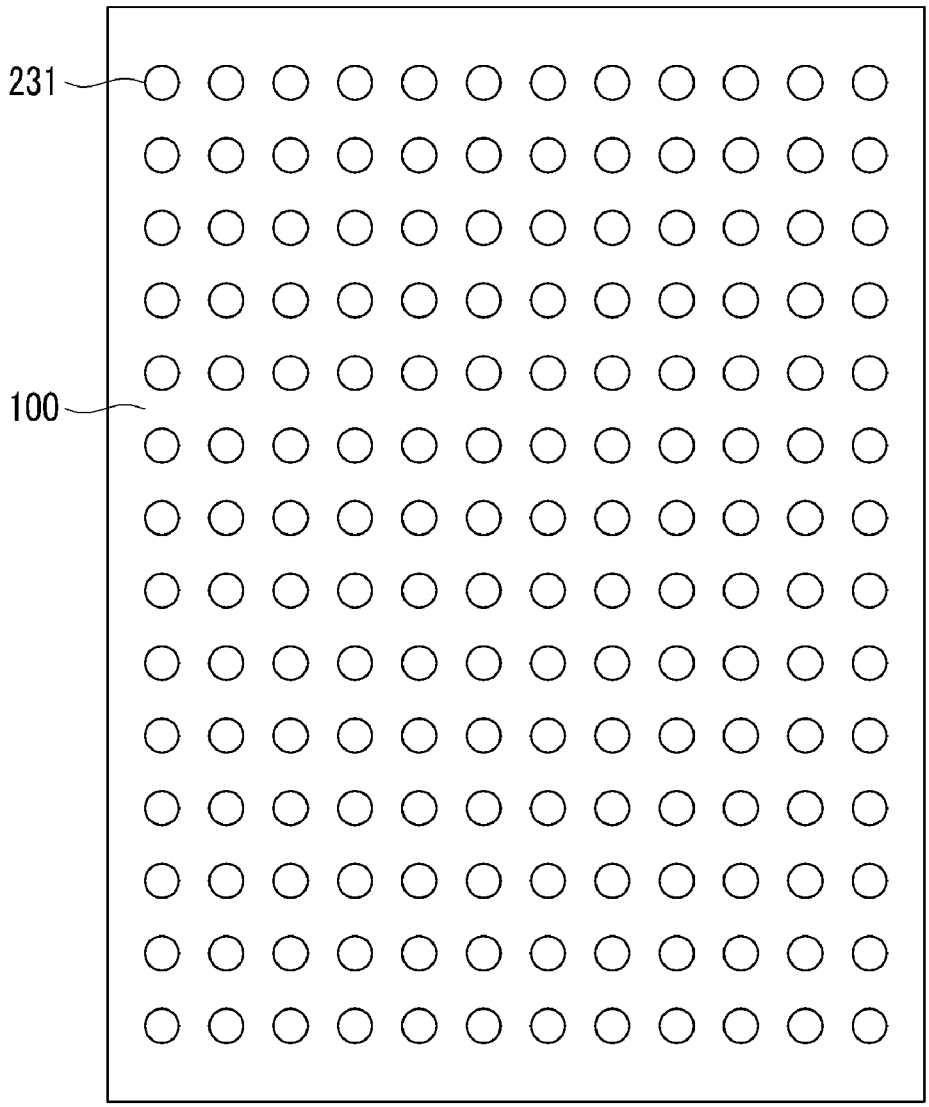
FIG. 9 is a view showing another exemplary embodiment of a method for compensating an ink dripping position, in a method for inkjet printing according to the invention.

FIG. 9 is a view showing another exemplary embodiment of a method for compensating an ink dripping position, in a method for inkjet printing according to the invention.

As shown in FIG. 9, in a case of a substrate with a relatively large size, a plurality of the dummy ink drop 231 is dripped arranged at a predetermined interval on substantially a whole surface of a substrate 100 in the plan view, the positions of the dripped dummy ink drops 231 are calculated into the CCD image, and then the escape value is compensated and calculated to measure the correct drip position of the plurality of the color filter ink drops for the formation of the color filter.

Again, where a dummy ink is deposited on a test pattern which includes test openings corresponding to dimensions of openings for an actual color filter of a display device, and a deviation of the deposited dummy ink from the dimensions of the test openings is used to set inkjet printing parameters before depositing color filter ink in the openings for the actual color filter, spread of ink between neighboring color filters due to misalignment of the dripped color filter ink may be reduced or effectively prevented, manufacturing costs and time may be reduced, and display characteristics of the display device may be improved.

While this invention has been described in connection with exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for inkjet printing, the method comprising:

providing a light blocking member pattern including a plurality of an opening at positions corresponding to pixels of a display device;

establishing a reference point for a drip of a dummy ink drop based on the openings;

dripping the dummy ink drop on a portion of the light blocking member pattern not including the openings, by using an inkjet printer;

providing a charge-coupled device image of the dripped dummy ink drop;

representing the charge-coupled device image on rectangular coordinates;

calculating a central point on an x-axis and a central point on a y-axis of the charge-coupled device image;

calculating an escape value as a distance the central point on the x-axis and the central point on the y-axis of the charge-coupled device image of the dripped dummy ink drop is deviated from the reference point, which is established by the inkjet printer;

calculating a time adjustment value of an ink drip on the basis of the escape value; and controlling a time of the ink drip for each nozzle of the inkjet printer by the time adjustment value of the ink drip.

2. The method of claim 1, wherein the dripping a dummy ink drop on the light blocking member pattern by using the inkjet printer is executed at substantially a same time or under the substantially a same condition as a process of disposing a color filter ink in the openings by inkjet printing.

3. The method of claim 2, wherein the calculating a time adjustment value of an ink drip on the basis of the escape value includes:

dividing the distance on the y-axis by a moving speed of the each nozzle of the inkjet printer when a proceeding direction of the inkjet printer is substantially parallel to y-axis.

4. The method of claim 1, wherein the reference point for the drip of the dummy ink drop established by the inkjet printer is determined with reference to a coordinate value of an edge or a center of an opening.

5. A method for inkjet printing, the method comprising:

establishing an ink drip position by an inkjet printer based on pixels of a display device;

dripping a dummy ink drop using the inkjet printer;

determining coordinates of a position of the dripped dummy ink drop;

calculating an escape value as a deviation of the dripped dummy ink drop from the established ink drip position;

calculating a time adjustment value of an ink drip on the basis of the escape value; and controlling a timing of the ink drip for each nozzle of the inkjet printer on the basis of the time adjustment value of the ink drip.

6. The method of claim 5, wherein:

the calculating a time adjustment value of an ink drip on the basis of the escape value includes:

dividing the value of a y-axis direction by a moving speed of the nozzle of the inkjet printer, when a printing direction of the inkjet printer is parallel to the y-axis direction.

7. The method of claim 6, further comprising, before the dripping a dummy ink drop using the inkjet printer;

providing a light blocking member pattern including a plurality of openings corresponding to positions of pixels of a display device, wherein the established ink drip position is determined with reference to a coordinate value of an edge or a center of the openings.

* * * * *